US007075491B2

(12) United States Patent
Nysen

(10) Patent No.: US 7,075,491 B2
(45) Date of Patent: Jul. 11, 2006

(54) PORTABLE RADIO ANTENNA SATELLITE SYSTEM, METHOD AND DEVICE

(75) Inventor: Paul A. Nysen, Sunnyvale, CA (US)

(73) Assignee: Amphenol-T&M Antennas, Vernon Hills, IL (US)

( * ) Notice: Subject to any disclaimer, the term of this patent is extended or adjusted under 35 U.S.C. 154(b) by 0 days.

(21) Appl. No.: 11/069,145

(22) Filed: Feb. 28, 2005

(65) Prior Publication Data

US 2005/0231430 A1 Oct. 20, 2005

Related U.S. Application Data

(60) Provisional application No. 60/548,694, filed on Feb. 27, 2004.

(51) Int. Cl.
*H01Q 1/24* (2006.01)

(52) U.S. Cl. ..... 343/718; 343/702; 343/700 MS

(58) Field of Classification Search ..... 343/718
See application file for complete search history.

(56) References Cited

U.S. PATENT DOCUMENTS 6,720,923 B1 * 4/2004 Hayward et al. .... 343/700 MS
6,980,165 B1 * 12/2005 Yuasa et al. ..... 343/718
2003/0160725 A1 * 8/2003 Baxter et al. ..... 343/702
2004/0203436 A1 * 10/2004 Oesterling ..... 455/67.11

* cited by examiner

*Primary Examiner*—Don Wong
*Assistant Examiner*—Binh Van Ho
(74) *Attorney, Agent, or Firm*—Greer, Burns & Crain, Ltd.

(57) ABSTRACT

The invention is directed to methods, devices and systems for receiving satellite radio broadcast signals by a portable device with multiple complementary antennas. Portable device, as used herein, indicates a device having a size that may be conveniently carried by a person in the fashion of portable AM/FM radios, CD players, MP3 players, etc. For example, the device may be clipped to an article of clothing. The invention particularly concerns a portable device antenna system for receiving a satellite radio broadcast. In an embodiment of the invention, a portable satellite radio device includes primary and supplemental antennas. The primary antenna covers a substantial portion of the azimuth direction and a vertical elevation within the range of about 20 to 60 degrees of vertical elevation. In one embodiment the primary antenna is a circularly polarized antenna. In use, however, part of the coverage in the azimuth direction will normally be blocked by a body of a person. A supplemental antenna provides coverage that is missing from the primary antenna. The supplemental antenna is packaged to be worn on another area of a person away from the primary antenna. A processor handles selection of signals from the primary and supplemental antennas and provides the signals to a digital satellite radio circuitry.

27 Claims, 1 Drawing Sheet

PORTABLE RADIO ANTENNA SATELLITE SYSTEM, METHOD AND DEVICE

PRIORITY CLAIM

Applicant claims priority benefit under 35 U.S.C. § 119 on the basis of Provisional Patent Application No. 60/548,694, filed Feb. 27, 2004.

FIELD OF THE INVENTION

The field of the invention satellite radio broadcasting.

BACKGROUND

A modern model for the reception of broadcast radio that has traditionally been provided on the AM and FM bands is the satellite radio broadcast model now becoming popular in stationary locations, such as buildings, and on mobile locations, primarily automobiles at the present time. The general model for satellite radio broadcast is to broadcast radio signals from a satellite directly to a receiver. In some cases, particularly in dense urban areas, the satellite transmission may also be supplemented by ground transmitted signals.

In the United States, the FCC has allocated a spectrum in the "S" band (2.3 GHz) for nationwide broadcasting of satellite-based digital audio radio service (DARS). Sirius Satellite Radio and XM Satellite Radio have licenses in this band and provide DARS via satellite broadcast. Outside of the United States, the "L" band has been designated for use and WorldSpace uses the "L" band to broadcast in Europe, Africa and Asia, and in South America.

XM Radio uses two satellites in parallel geostationary orbits, one at 85 degrees west longitude and the other at 115 degrees west longitude. Radio receivers are programmed to receive and unscramble the digital data signal, which contains many channels of digital audio. In addition to the encoded sound, the signal contains additional information about the broadcast. The song title, artist and genre of music are all displayed on the radio. Sirius uses three satellites that form an inclined elliptical satellite constellation. WorldSpace, like XM uses geostationary satellites and provides DARS in the 1,467- to 1,492-megahertz (MHz) segment of the L-Band spectrum.

Energy traveling from satellites experiences a very large amount of attenuation. The power flux density incident at an antenna on an automobile, for example, may be on the order of $10^{-14}$ watts per square meter. Even in car installations, providing antenna systems has been difficult because the antennas must blend in with the automobile from an aesthetic point of view to be acceptable to consumers. In addition, the car provides blocking and attenuation effects that must be overcome.

A very desirable way to receive DARS from satellites would be on a truly portable unit, one that can be worn on the body of a person. The body unit presents antenna problems that are even more difficult to address, as antennas typically used for satellite reception in other applications (e.g., automobiles) to receive circularly polarized S and L band satellite broadcasts are not well suited to be worn on the body, and the body itself provides blocking effects.

SUMMARY OF THE INVENTION

The invention is directed to methods, devices and systems for receiving satellite radio broadcast signals by a portable device with multiple complementary antennas. Portable device, as used herein, indicates a device having a size that may be conveniently carried by a person in the fashion of portable AM/FM radios, CD players, MP3 players, etc. For example, the device may be clipped to an article of clothing. The invention particularly concerns a portable device antenna system for receiving a satellite radio broadcast.

In an embodiment of the invention, a portable satellite radio device includes primary and supplemental antennas. The primary antenna covers a substantial portion of the azimuth direction and a vertical elevation within the range of about 20 to 60 degrees of vertical elevation. In one embodiment the primary antenna is a circularly polarized antenna. In use, however, part of the coverage in the azimuth direction will normally be blocked by a body of a person. A supplemental antenna provides coverage that is missing from the primary antenna. The supplemental antenna is packaged to be worn on another area of a person away from the primary antenna. A processor handles selection of signals from the primary and supplemental antennas and provides the signals to a digital satellite radio circuitry.

DESCRIPTION OF THE EXEMPLARY EMBODIMENTS

Figure 1:
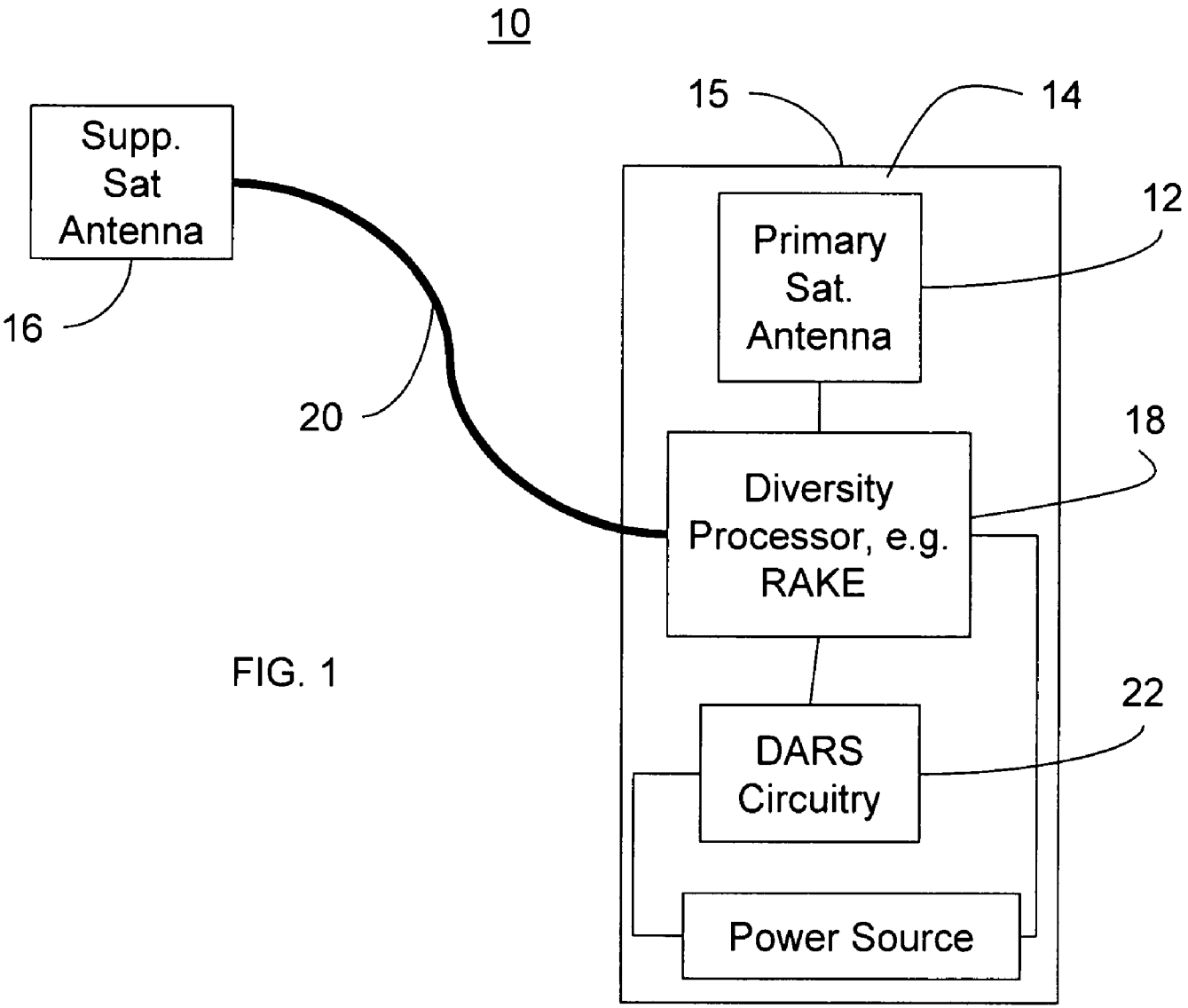
FIG. 1 is a block diagram of an exemplary embodiment digital satellite radio receiver system of the invention.

The invention is directed to methods, devices and systems for receiving satellite radio broadcast signals by a portable device with multiple complementary antennas. Portable device, as used herein, indicates a device having a size that may be conveniently carried by a person in the fashion of portable AM/FM radios, CD players, MP3 players, etc. For example, the device may be clipped to an article of clothing. The invention particularly concerns a portable device antenna system for receiving a satellite radio broadcast.

A portable sized receiver for satellite radio broadcasts presents significant challenges for antennas. The human body blocks antenna line of site in the azimuth direction in any location other than the very top of the head, which is an inconvenient location for antenna placement given the types of antennas that have been used in satellite radio broadcast receivers. Even automobiles have presented difficulties as manufacturers have struggled to produce antennas that conform to size and space constraints for an unobtrusive automobile installation. A quadrifilar helix antenna is one type of antenna that has been used in automobile installations, but has a height directly related to its impedance and has a quarter wavelength height (or shorter with an appropriate impedance matching circuit) in the S and L frequency bands used for satellite radio broadcasting. Height reductions have a negative impact on antenna gain. This presents a puzzle, because an antenna that performs well for receiving satellite radio broadcast should exhibit a wide hemispherical or cardioid shaped radiation pattern. To receive S band or L band satellite radio broadcast, an antenna should exhibit omni directional coverage in the azimuth direction and should exhibit coverage within a range of about 20 to 60 degrees of vertical elevation.

Embodiments of the present invention provide a satellite radio antenna system, a method and a receiver device. With reference to FIG. 1, a preferred embodiment of the invention is a satellite band antenna system 10 including a primary antenna 12 that is mounted upon or within a satellite digital radio device 14. The primary antenna 12 covers a substantial portion of the azimuth direction and a vertical elevation within the range of about 20 to 60 degrees of vertical elevation. In one embodiment the primary antenna is a circularly polarized antenna. In use, however, part of the coverage in the azimuth direction will normally be blocked by a the body of a person as the satellite digital radio device 14 is packaged in a housing 15, for example, with a clip to be worn on a belt or pocket of a person. The primary antenna 12 in other exemplary embodiments is of a form that does not see the full circularly polarized signal of the satellite broadcast, and may often be made smaller that a circularly polarized antenna, depending upon the style of antenna used for the primary antenna. The sacrifice in gain due to the directional nature of an antenna or the blocking by the body of a person of a circularly polarized antenna is made up for by a supplemental antenna 16. The supplemental antenna 16 is packaged to be worn on another area of a person away from the primary antenna 14 so that the supplemental antenna 16 has a different view than the primary antenna 14. For example, the supplemental antenna 16 is connected to a processor 18 in the digital satellite radio device 14 via an extended wire 20 that permits a package including a clip or other means to mount the supplemental antenna 16 on another area of a person away from the primary antenna. The processor 18 handles selection of signals from the primary and supplemental antennas and provides the signals to a digital satellite radio circuitry 22, which may be conventional and handles, for example, the decoding of signals and the output of signals in audio form. The digital satellite radio device 14 also includes a portable power source 24, such as a rechargeable battery or other power source used typically in portable audio devices.

An important recognition of the invention is that an antenna system for satellite reception may be based upon a primary antenna that is directional in the azimuth direction (or at least is effectively blocked in some direction) and may, in embodiments, not circularly polarized. In the invention, another antenna supplements the coverage of the primary antenna, and the signals from the primary antenna and the supplemental antenna (or a plurality of supplemental antennas) are controlled to permit a receiver to decode the satellite radio broadcast. In an exemplary embodiment of the invention, switching between the primary and supplemental antenna is used as control. In another exemplary embodiment, diversity processing is used as control.

An exemplary embodiment conducts a control based upon scanning for the strongest signal of all of the primary and supplemental antennas. In one embodiment each antenna is given equal priority during the scan, and in other embodiments an antenna may be assigned individual priority. The scan time needs to be relatively short compared to the signal replication time, which is the time allotted for correlating the received satellite signals. In DARS, it is typical for replicated and delayed signals to be transmitted. The delay between the replicated signals is a replication time. The replication permits processing to overcome the severe fading experienced in satellite transmission.

Diversity processing may use, for example, a CDMA technique. A preferred embodiment uses a RAKE receiver(s) that has time and spatial diversity, as in CDMA. In the invention, spatial directions are deliberately chosen among the primary and supplemental antennas. A group n of the strongest echoes from one or more of the primary and supplemental antennas (possibly from one or multiple antennas) is selected by the receiver.

Having been freed from constraints imposed by the typical model for satellite radio antennas, the primary antenna of the invention may be, for example a patch antenna, and may be carried on various locations of the human body. A directional patch style antenna, in certain embodiments tuned with slots, may, for example be kept small. An example embodiment is a patch having a footprint of about 15 mm by 15 mm. A patch in example embodiments may be a vertically looking antenna, and it may be worn in various locations on a person. It may be worn on the shoulder, on a lapel location looks only forward; in a waist location, e.g., worn on a belt or waist pack. The antenna in preferred embodiments preferably exhibits a cardioid shaped radiation pattern, and in preferred embodiments is packaged, such as on a satellite radio receiver or on a mount such as a clip, and configured to be worn on a waist location. Worn on a waist location, the preferred primary antenna provides approximately 180 degrees of coverage in the azimuth direction and coverage falling within about 20 to 60 degrees of vertical elevation. A supplemental antenna may, for example, be packaged for mounting on another side of the belt from the primary antenna, or it may be packaged to be worn on the shoulder or a person. The supplemental antenna fills in the missing part of horizontal coverage left by the pattern of the primary antenna and has coverage falling within the about 20 degree to 60 degree of vertical elevation range.

Another example embodiment of the invention includes a primary antenna packaged to be located at an arbitrary location of the body of a person. The primary antenna has coverage falling within about 20 degrees of 60 degrees of vertical elevation and an incomplete horizontal pattern. The primary antenna may be circularly or vertically polarized. A supplemental antenna fills in substantially all of the incomplete horizontal pattern and is packaged to be worn on a location to fill in the incomplete horizontal patter and have coverage falling within about 20 degrees to 60 degrees of vertical elevation.

With a placement of a primary and a supplemental antenna according the above mentioned embodiments, control is implemented to permit a receiver to decode the satellite radio broadcast. One approach is to take advantage of any memory provided in the satellite radio broadcast transmission. For example, the commercial XM radio service available in North America includes a four second delay (discussed above) in the radio broadcast transmission. This delay may be utilized to evaluate the signals from the primary and supplemental antennas for the purpose of selecting the strongest signal or signals, without disturbing the integrity of the data from the satellite transmission. It must be anticipated that this evaluation process must not exceed the available delay defined in the satellite signal.

As had been mentioned, the physical form of antenna used for a primary and/or supplemental antenna may be directional and linear. Used in receiving a satellite radio broadcast that is circularly polarized, a linear antenna experiences a 3 dB loss. Furthermore, flat, low-profile antennas are preferred in the invention for the reason that such antennas may be packaged to be conveniently carried on a person. An example embodiment of the invention utilizes a simple di-pole, which has 2 dB of gain, but would only see half of the gain from the satellite radio broadcast. The antenna includes an intentional reflector on the back of the dipole antenna to block out the coverage to be supplied by the supplemental antenna, and this blocking effect gives additional gain back to the dipole antenna. The antenna is packaged to look vertically up in the 20–60 degree range of vertical elevation.

A preferred embodiment antenna may be linear or circularly polarized patches, dipoles or monopoles, slots or notch antennas, PIFA antennas, and other low profile antennas that may be tuned to the appropriate band. A suitable packaging may be for example, a belt mounting of a patch or a dipole with a reflector. Another may be a headset mounted patch or dipole. Preferred embodiments use a top-loaded monopole or dipole.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

The invention claimed is:

1. A method for receiving a satellite radio broadcast in the S or L satellite bands, the method comprising steps of:

providing a primary antenna packaged to be worn on an area of a person, the primary antenna being configured to receive S or L band satellite radio broadcast signals in a pattern covering a substantial but incomplete portion of the azimuthal direction and to exhibit coverage falling with the range of about 20 to 60 degrees of vertical elevation;

providing a supplemental antenna packaged to be worn on another area of a person, the supplemental antenna being configured to receive S or L band satellite radio broadcast signals in a pattern covering the incomplete portion of the azimuthal direction and to exhibit coverage falling with the range of about 20 to 60 degrees of vertical elevation; and controlling signals from the primary and supplemental antennas to permit decoding of the S or L band satellite radio broadcast signals.

2. The method of claim 1, wherein said step of providing a primary antenna comprises providing a patch antenna packaged to be worn on area of a person.

3. The method of claim 2, wherein the primary antenna comprises a circularly polarized antenna.

4. The method of claim 3, wherein the primary antenna has a footprint of about 15 mm by 15 mm.

5. The method of claim 3, wherein the primary antenna is packaged to be worn on one of a shoulder, a lapel location, and a waist location.

6. The method of claim 3, wherein the primary antenna is packaged on a satellite radio receiver.

7. The method of claim 6, wherein said step of providing a supplemental antenna comprises providing a supplemental antenna packaged to be worn on the another area of a person away from the primary antenna.

8. The method of claim 2, wherein the patch antenna comprises a directional antenna.

9. The method of claim 8, wherein the primary antenna has a footprint of about 15 mm by 15 mm.

10. The method of claim 8, wherein the primary antenna is packaged to be worn on one of a shoulder, a lapel location, and a waist location.

11. The method of claim 8, wherein the primary antenna is packaged on a satellite radio receiver.

12. The method of claim 11, wherein said step of providing a supplemental antenna comprises providing a supplemental antenna packaged to be worn on the another area of a person away from the primary antenna.

13. The method of claim 1, wherein said step of controlling comprises switching between the primary and supplemental antennas.

14. The method of claim 1, wherein said step of controlling comprises diversity processing signals from the primary and supplemental antennas.

15. The method of claim 14, wherein said step of controlling comprises scanning for the strongest signal of the primary and supplemental antennas and selecting the strongest signal, and wherein said step of scanning is conducted within a time period permitted by the signal replication time for the satellite radio broadcast.

16. The method of claim 15, wherein, during said step of scanning, each of the primary and supplemental antennas is given equal priority during the scan.

17. The method of claim 15, wherein, during said step of scanning, one of the primary and supplemental antennas is assigned a higher priority than the other.

18. The method of claim 14, wherein said step of diversity processing comprises selecting one of a group n of the strongest echoes from the primary and supplemental antennas.

19. The method of claim 18, wherein said step of providing a supplemental antenna provides a plurality of supplemental antennas, and said step of diversity processing selects one of a group n of the strongest echoes from the primary antenna and the plurality of supplemental antennas.

20. The method of claim 1, wherein said step of controlling uses a delay in the satellite radio broadcast to select the strongest signal from the primary and supplemental antennas in a time period short enough to avoid disturbing the integrity of the data from the satellite transmission.

21. A portable digital satellite radio device for receiving a digital satellite radio broadcast in the S or L satellite bands, the device comprising:

a housing;

digital satellite radio receiver circuitry within said housing;

a primary antenna packaged within or upon said housing to be worn on an area of a person, the primary antenna being configured to receive S or L band satellite radio broadcast signals in a pattern covering a substantial but incomplete portion of the azimuthal direction and to exhibit coverage falling with the range of about 20 to 60 degrees of vertical elevation;

a supplemental antenna packaged to be worn on another area of a person, the supplemental antenna being configured to receive S or L band satellite radio broadcast signals in a pattern covering the incomplete portion of the azimuthal direction and to exhibit coverage falling with the range of about 20 to 60 degrees of vertical elevation;

a processor for processing and selecting signals from the primary and supplemental antennas and for providing signals to said digital satellite radio receiver circuitry to permit decoding of the S or L band satellite radio broadcast signals.

22. The device of claim 21, further comprising a portable power source within said housing for powering said digital satellite radio receiver circuitry and said processor.

23. The device of claim 21, wherein said primary antenna comprises a circularly polarized antenna.

24. The device of claim 23, wherein said primary antenna comprises a patch antenna.

25. The device of claim 23, wherein said supplemental antenna comprises a circularly polarized antenna.

26. The device of claim 21, wherein said primary antenna comprises a directional antenna.

27. The device of claim 21, wherein said primary antenna comprises one of a linear polarized patch, a circularly polarized patch, a dipole, a monopole, a slot, a notch antenna, and a planar inverted F antenna.

* * * * *